US007284835B2

(12) United States Patent
Watanabe

(10) Patent No.: US 7,284,835 B2
(45) Date of Patent: Oct. 23, 2007

(54) INK-JET HEAD

(75) Inventor: Hidetoshi Watanabe, Tokoname (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 244 days.

(21) Appl. No.: 10/912,248

(22) Filed: Aug. 6, 2004

(65) Prior Publication Data

US 2005/0036007 A1 Feb. 17, 2005

(30) Foreign Application Priority Data

Aug. 14, 2003 (JP) ..... 2003-293522

(51) Int. Cl.
*B41J 2/04* (2006.01)

(52) U.S. Cl. ..... 347/54

(58) Field of Classification Search ..... 347/54, 347/63, 65, 68, 40
See application file for complete search history.

(56) References Cited

U.S. PATENT DOCUMENTS

| | | | | |
|---|---|---|---|---|
| 4,730,197 | A * | 3/1988 | Raman et al. | 347/40 |
| 5,495,270 | A * | 2/1996 | Burr et al. | 347/10 |
| 5,757,400 | A | 5/1998 | Hoisington | |
| 6,003,971 | A | 12/1999 | Hanks et al. | |
| 6,019,464 | A | 2/2000 | Tsukada et al. | |
| 6,290,340 | B1 * | 9/2001 | Kitahara et al. | 347/70 |
| 6,488,355 | B2 * | 12/2002 | Nakamura et al. | 347/40 |
| 6,523,942 | B2 * | 2/2003 | Sakamoto et al. | 347/68 |
| 6,536,879 | B2 | 3/2003 | Ito et al. | |
| 6,685,305 | B2 | 2/2004 | Okuda | |
| 6,758,553 | B2 * | 7/2004 | Hirota et al. | 347/68 |
| 6,840,602 | B2 | 1/2005 | Watanabe et al. | |
| 2002/0036678 | A1 | 3/2002 | Ito et al. | |

FOREIGN PATENT DOCUMENTS

| | | |
|---|---|---|
| CN | 1426896 | 7/2003 |
| EP | 1-264-693 A2 | 12/2002 |
| JP | A-9-150511 | 6/1997 |
| JP | A-9-150512 | 6/1997 |
| JP | B2 3231786 | 9/2001 |
| JP | A-2001-287361 | 10/2001 |
| JP | A-2002-96478 | 4/2002 |
| JP | A-2002-307676 | 10/2002 |
| JP | A-2003-165214 | 6/2003 |
| WO | WO97/28000 | 8/1997 |

* cited by examiner

*Primary Examiner*—Anh T. N. Vo
(74) *Attorney, Agent, or Firm*—Oliff & Berridge, PLC

(57) ABSTRACT

A flow path unit of an ink-jet head includes a sub-manifold 5*a* communicating with nozzles and pressure chambers through ink supply ports 13*a*. The plural ink supply ports 13*a* are formed in the upper surface of the sub-manifold 5*a* and in areas close to both side ends in the longitudinal direction of the sub-manifold 5*a*.

20 Claims, 10 Drawing Sheets

INK-JET HEAD

BACKGROUND OF THE INVENTION

1. Field of the Invention

The present invention relates to an ink-jet head used in an ink-jet recording apparatus for discharging ink to print on a recording medium.

2. Description of the Related Art

An ink-jet head distributes ink supplied from an ink tank to a manifold to plural pressure chambers arranged in a matrix form. Pressure is selectively given to the respective pressure chambers by an actuator unit having a sheet-like piezoelectric ceramic, so that the ink is discharged from ink discharge ports connected to the respective pressure chambers.

With respect to the arrangement of the pressure chambers in the ink-jet head, there are a one-dimensional arrangement in which for example, one or two lines are arranged in a head direction, and a two-dimensional arrangement of a matrix form along a head surface. In order to achieve high resolution and high speed of printing requested in recent years, it is more effective to arrange the pressure chambers two-dimensionally. As an example of an ink-jet head in which pressure chambers are arranged two-dimensionally along the surface, there is known one in which a nozzle is arranged at the center of the pressure chamber when viewed in a direction vertical to a head surface (see Japanese Patent No. 3231786). In this case, when a pulse-like pressure is given to the pressure chamber, a pressure wave is transmitted in the pressure chamber in the direction vertical to the head surface, and ink is discharged from the nozzle arranged at the center of the pressure chamber when viewed in the direction vertical to the head surface.

However, in the ink-jet head disclosed in Japanese Patent No. 3231786, replenishing guide holes (ink supply ports) formed at the center of a branch duct (sub-manifold) branching from a supply duct (manifold) are communicated with a passage, and ink is supplied into the pressure chamber. In the case where air bubbles exist in the branch duct, even if an attempt is made to eject the air bubbles from the branch duct through the replenishing guide hole by a purge operation, since the replenishing guide holes are discretely provided only at the center of the branch duct, there is a possibility that hard-to move air bubbles existing at both side end upper angle parts in the width direction in the branch duct and being in contact with the inner surface of the branch duct at two points can not be ejected. That is, when an air bubble is in contact with the inner surface of the branch duct at two points, the air bubble has large contact resistance to the wall surface of the branch duct and can not be smoothly moved in the branch duct, and therefore, there occurs a possibility that the air bubble can not be ejected to the outside through the nozzle from the replenishing guide hole provided only at the center of the branch duct.

SUMMARY OF THE INVENTION

It is an object of the invention to provide an ink-jet head in which air bubbles in a common ink chamber are easily ejected to the outside.

According to one aspect of the invention, an ink-jet head includes plural pressure chambers communicating with nozzles and arranged in a matrix form along a plane so that plural pressure chamber lines are formed in one direction on the plane, and a common ink chamber extending in the one direction and communicating with the plural pressure chambers. The common ink chamber is provided with plural ink supply ports for supplying ink in the common ink chamber to individual ink flow paths extending through the pressure chambers to the nozzles, and on a wall surface, in which the ink supply ports are formed, of wall surfaces constituting the common ink chamber, a total opening square measure of the ink supply ports formed in areas close to both side ends in a direction vertical to the one direction is larger than a total opening square measure of the ink supply ports formed in a center area other than the areas close to both the side ends.

By thus construction, as compared with the case where the replenishing guide holes are provided only in the center portion of the branch duct, it becomes easy to eject the air bubbles in the common ink chamber from the nozzles to the outside through the ink supply ports. Accordingly, it is possible to reduce the occurrence of poor ink discharge due to the existence of the air bubbles remaining at the time of printing.

According to another aspect of the invention, an ink-jet head includes plural pressure chambers communicating with nozzles and arranged in a matrix form along a plane so that plural pressure chamber lines are formed in one direction on the plane, and a common ink chamber extending in the one direction and communicating with the plural pressure chambers. The common ink chamber is provided with plural ink supply ports for supplying ink in the common ink chamber to individual ink flow paths extending through the pressure chambers to the nozzles, and on a wall surface, in which the ink supply ports are formed, of wall surfaces constituting the common ink chamber, a total opening square measure of the ink supply ports formed in areas at both sides of the common ink chamber divided into three equal parts in a direction vertical to the one direction is larger than a total opening square measure of the ink supply ports formed in a center area other than the areas at both the sides.

It is preferable that the plural ink supply ports formed in the areas close to both the side ends or the areas at both the sides are arranged so that at least part of them overlap with each other when viewed in the one direction.

It is preferable that respective square measures of the plural ink supply ports formed in the common ink chamber are equal to each other, and the total number of the ink supply ports formed in the areas close to both the side ends or the areas at both the sides is larger than the total number of the ink supply ports formed in the center area. By this, a manufacture process is simplified, and design becomes simple.

It is preferable that the ink supply ports are formed only in the areas close to both the side ends or in the areas at both the sides. By this, air bubbles can be more efficiently ejected.

At this time, an inside surface of a wall surface put between both side walls of the common ink chamber may be a plane surface. By this, the structure becomes simple.

It is preferable that an inside surface of a wall surface put between both side walls of the common ink chamber has a shape in which the center area protrudes toward an inside of the common ink chamber. By this, the air bubbles can be more efficiently ejected.

It is preferable that at a wall surface put between both side walls of the common ink chamber, a thin and long recess in the one direction is formed in an area surrounding the plural ink supply ports in the one direction. By this, the air bubbles are more easily ejected.

At this time, a width of the recess in a direction orthogonal to the one direction may be larger than a diameter of the ink supply port. By this, since the air bubbles can be smoothly moved in the recess, the air bubbles are more easily ejected.

DESCRIPTION OF THE PREFERRED EMBODIMENTS

Hereinafter, preferred embodiments of the present invention will be described with reference to the drawings.

Figure 1:
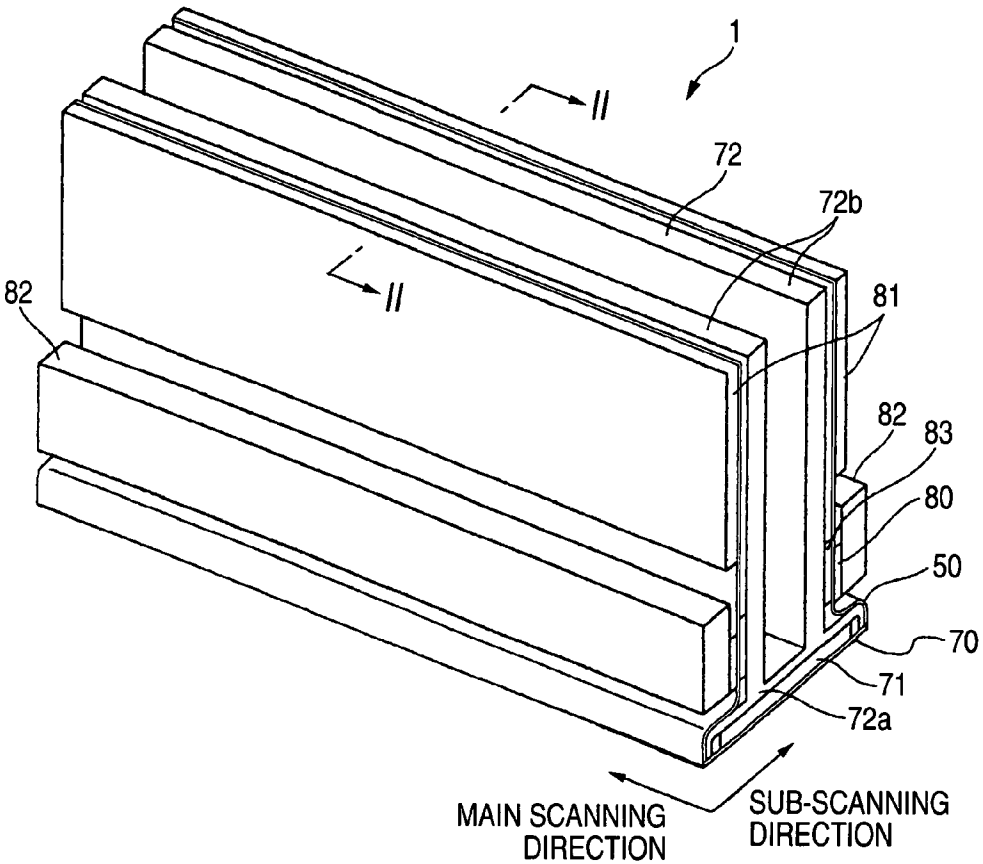
FIG. 1 is an outside perspective view of an ink-jet head according to a first embodiment of the invention.
Figure 2:
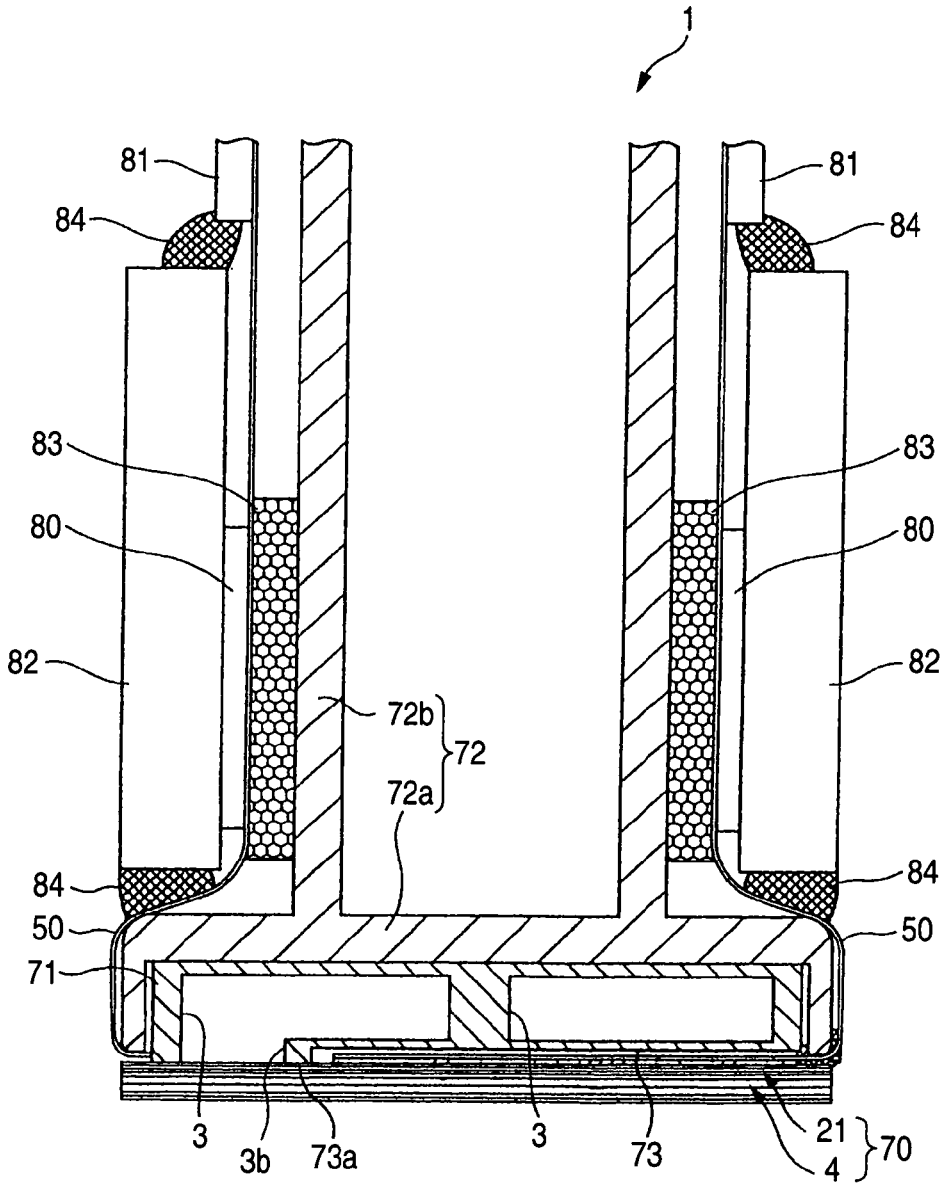
FIG. 2 is a sectional view taken along line II-II of FIG. 1.

FIG. 1 is an outside perspective view of an ink-jet head according to a first embodiment of the invention. FIG. 2 is a sectional view taken along line II-II of FIG. 1. An ink-jet head 1 includes a head main body 70 for discharging ink to a sheet, which extends in a main scanning direction and has a rectangular plane shape, and a base block 71 which is disposed above the head main body 70 and in which ink reservoirs 3 as flow paths of ink supplied to the head main body 70 are formed.

The head main body 70 includes a flow path unit 4 in which the ink flow paths are formed, and plural actuator units 21 bonded to the upper surface of the flow path unit 4. The flow path unit 4 and the actuator units 21 are constructed such that plural sheet-like members are laminated and bonded to each other. A flexible printed circuit (FPC: Flexible Printed Circuit) 50 as a feeding member is bonded to the upper surface of the actuator unit 21, and the FPC 50 is led out to the upper part while being bent in FIG. 2. The base block 71 is made of metal material, for example, stainless. The ink reservoir 3 in the base block 71 is substantially a rectangular parallelepiped hollow area formed in the longitudinal direction of the base block 71.

A lower surface 73 of the base block 71 protrudes downward from a surrounding area in the vicinity of an opening 3*b*. The base block 71 is in contact with the flow path unit 4 only at a portion 73*a* near the opening 3*b* of the lower surface 73. Thus, an area other than the portion 73*a* near the opening 3*b* of the lower surface 73 of the base block 71 is separate from the head main body 70, and the actuator unit 21 is disposed in this separate portion.

The base block 71 is bonded and fixed to a recess formed in the lower surface of a grip part 72*a* of a holder 72. The holder 72 includes the grip part 72*a* and a pair of flat-shaped protrusions 72*b* extending from the upper surface of the grip part 72*a* in a direction orthogonal to this and spaced from each other by a specified interval. The FPC 50 bonded to the actuator unit 21 is arranged along the surface of each of the projections 72*b* of the holder 72 through an elastic member 83 such as a sponge. A driver IC 80 is disposed on the FPC 50 arranged on the surface of the projection 72*b* of the holder 72. In order to send a drive signal outputted from the driver IC 80 to the actuator unit 21 (described later in detail) of the head main body 70, the FPC 50 is electrically connected to both by soldering.

Since a heat sink 82 having substantially a rectangular parallelepiped shape is disposed to be in close contact with the outer surface of the driver IC 80, heat generated by the driver IC 80 can be efficiently dissipated. A board 81 is disposed above the driver IC 80 and the heat sink 82 and outside the FPC 50. Seal members 84 are respectively disposed between the upper surface of the heat sink 82 and the board 81, and between the lower surface of the heat sink 82 and the FPC 50, and they are respectively bonded to each other by the seal members 84.

Figure 3:
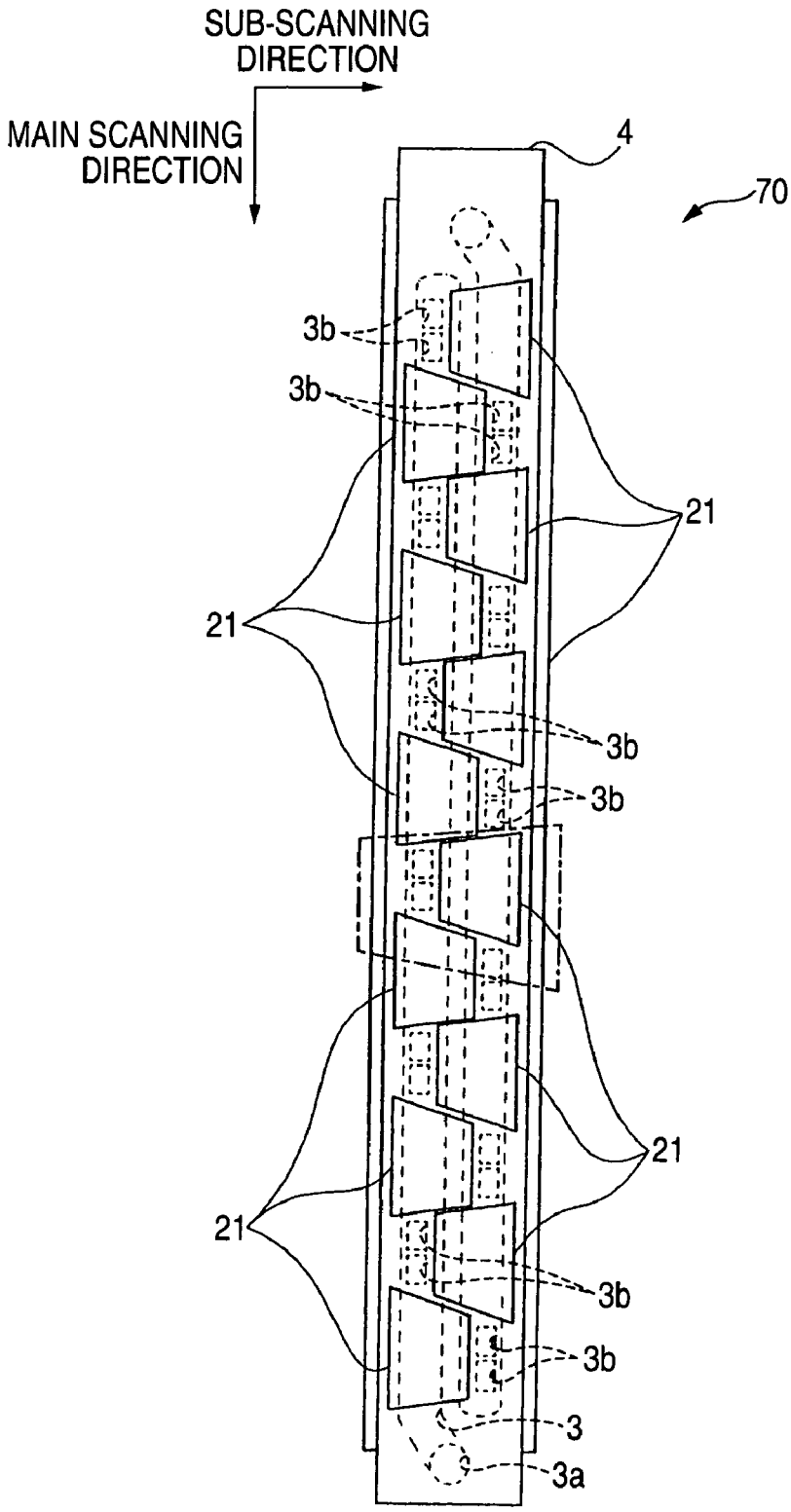
FIG. 3 is a plan view of a head main body included in the ink-jet head shown in FIG. 2.

FIG. 3 is a plan view of the head main body included in the ink-jet head shown in FIG. 2. In FIG. 3, the ink reservoirs 3 formed in the base block 71 are imaginarily shown by broken lines. The two ink reservoirs 3 extend in parallel to each other in the longitudinal direction of the head main body 70 and are spaced from each other by a specified interval. Each of the two ink reservoirs 3 has an opening 3*a* at one end and communicates with an ink tank (not shown) through this opening 3*a*, so that it is always filled with ink. The many openings 3*b* are provided for the respective ink reservoirs 3 in the longitudinal direction of the head main body 70, and connect the respective ink reservoirs 3 and the flow path unit 4 as described above. The many openings 3*b* include pairs and the two openings of each of the pairs are disposed to be close to each other in the longitudinal direction of the head main body 70. The pairs of the openings 3*b* communicating with the one ink reservoir 3 and the pairs of the openings 3*b* communicating with the other ink reservoir 3 are arranged in a staggered manner.

In the areas where the openings 3*b* are not arranged, the plural actuator units 21 having trapezoidal plane shapes are arranged in a staggered manner and in a pattern opposite to the pairs of the openings 3*b*. Parallel opposite sides (upper side and lower side) of each of the actuator units 21 are parallel to the longitudinal direction of the head main body 70. Parts of oblique sides of the adjacent actuator units 21 overlap with each other in the width direction of the head main body 70.

Figure 4:
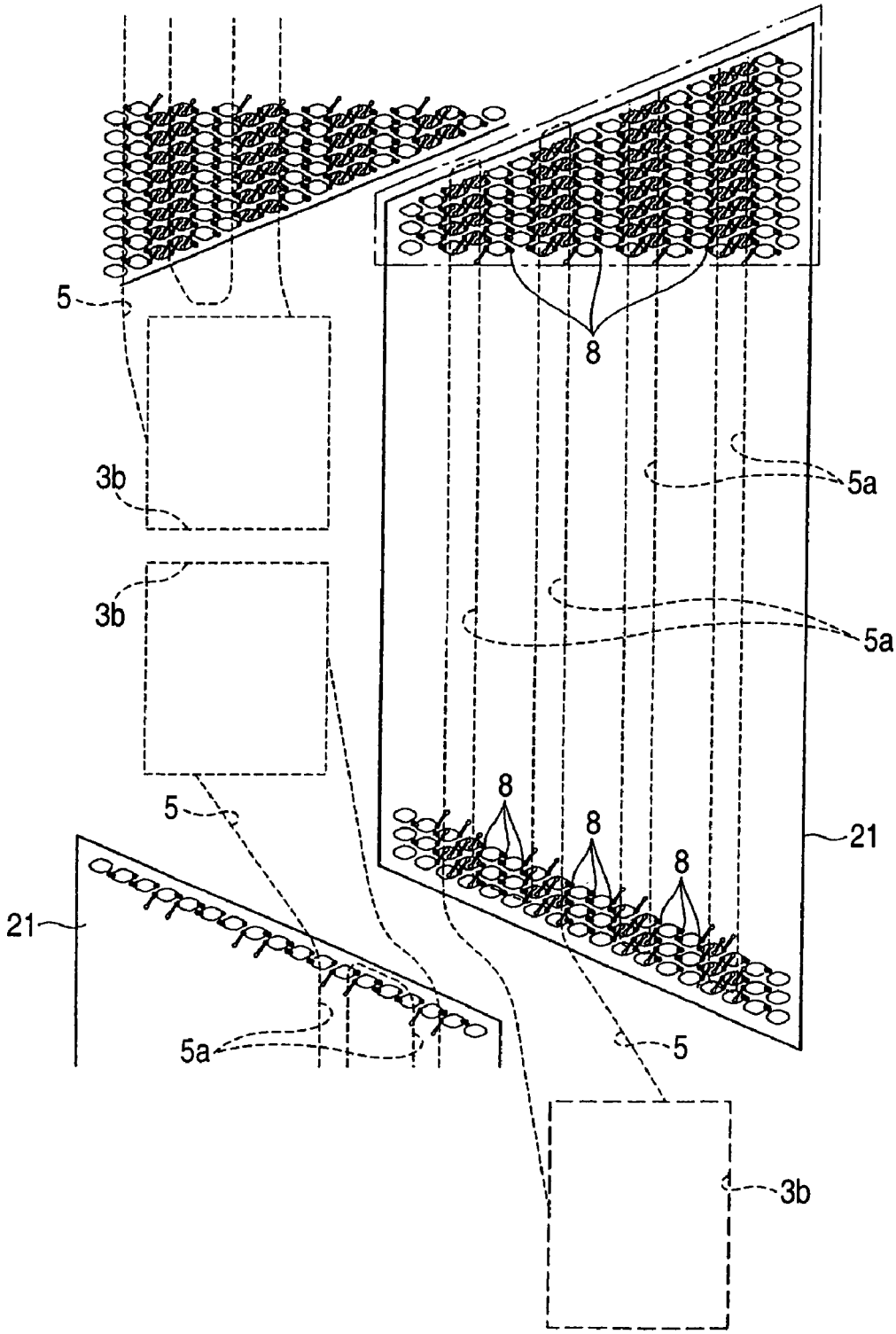
FIG. 4 is an enlarged view of an area surrounded by a one-dot chain line of FIG. 3.

FIG. 4 is an enlarged view of an area surrounded by a one-dot chain line drawn in FIG. 3. As shown in FIG. 4, the openings 3*b* provided for each of the ink reservoirs 3 communicate with manifolds 5, and a tip end of each of the manifolds 5 branches into two and forms sub-manifolds 5*a*. Besides, when viewed on a plane, the two sub-manifolds 5*a* branching from the adjacent opening 3*b* extend from each of the two oblique sides of the actuator unit 21. That is, under the actuator unit 21 in the lamination direction, the four sub-manifolds 5*a* separate from each other extend along the parallel opposite sides of the actuator unit 21. The manifolds 5 and the sub-manifolds 5*a* are common ink chambers in the flow path unit 4.

The lower surface of the flow path unit 4 corresponding to the bonded area of the actuator unit 21 is an ink discharge area. Many nozzles 8 are arranged in a matrix form on the surface of the ink discharge area as described later. For the purpose of simplifying the drawing, only some of the nozzles 8 are shown in FIG. 4, however, they are actually arranged all over the ink discharge area.

Figure 5:
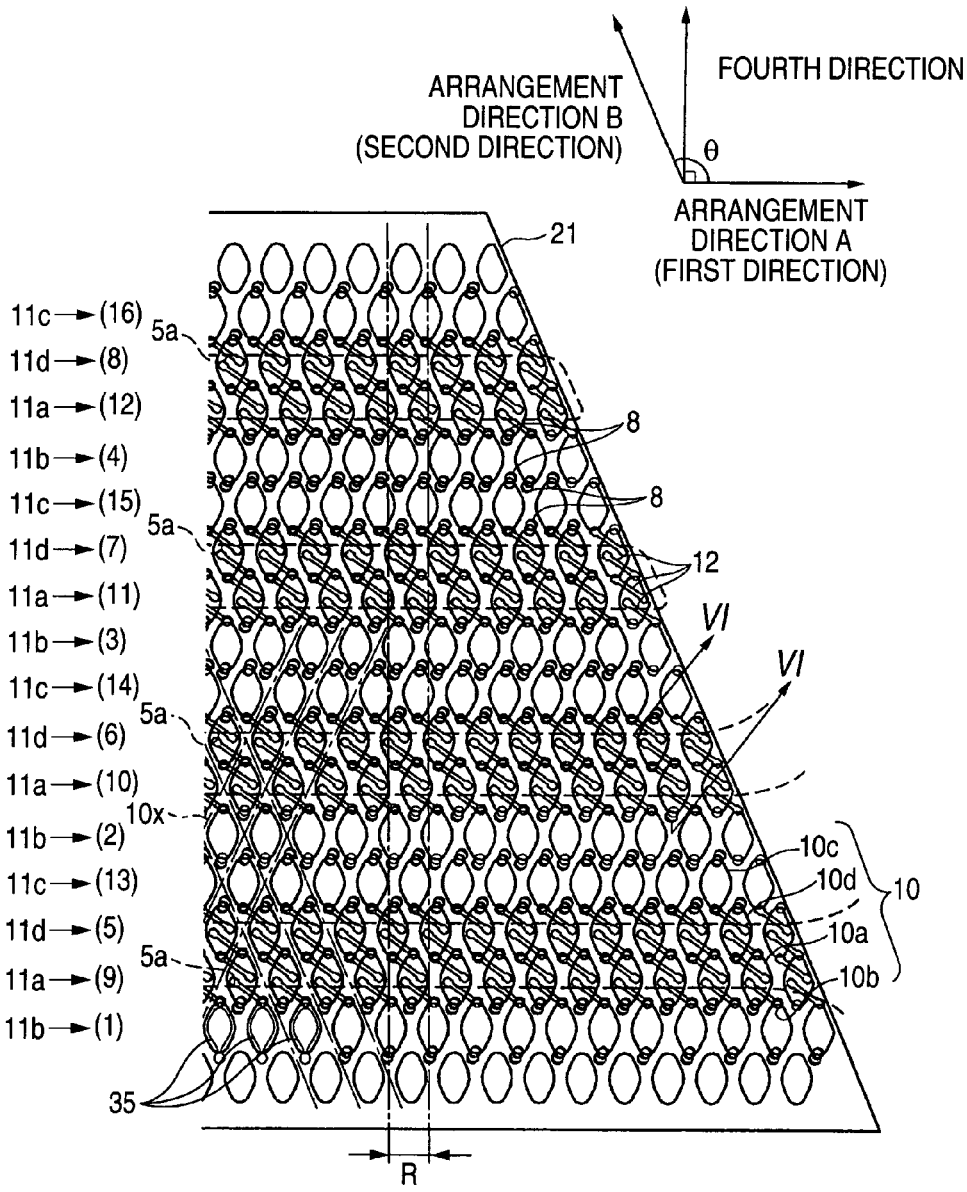
FIG. 5 is an enlarged view of an area surrounded by a one-dot chain line of FIG. 4.

FIG. 5 is an enlarged view of an area surrounded by a one-dot chain line drawn in FIG. 4. FIGS. 4 and 5 show a state where a plane on which many pressure chambers 10 of the flow path unit 4 are arranged in a matrix form is seen in a direction vertical to the ink discharge surface. Each of the pressure chambers 10 has a rhombic plane shape in which radius is given to each corner part, and a longer diagonal line is parallel to the width direction of the flow path unit 4. One end of each of the pressure chambers 10 corresponding to one acute angle part of the pressure chamber 10 communicates with the nozzle 8, and the other end corresponding to the other acute angle part of the pressure chamber 10 communicates with the sub-manifold 5*a* through an aperture 12. When viewed on a plane, at a position overlapping with each of the pressure chambers 10, an individual electrode 35 having a plane shape similar to the pressure chamber 10 and one size smaller than this is formed on the actuator unit 21. FIG. 5 shows only some of the many individual electrodes 35 to simplify the drawing. Incidentally, in FIGS. 4 and 5, for the purpose of making the drawings plain, the pressure chambers 10, the apertures 12 and the like which exist in the actuator unit 21 or the flow path unit 4 and should be drawn by broken lines, are drawn by solid lines.

In FIG. 5, plural imaginary rhombic areas 10*x* in which the pressure chambers 10 are respectively contained are adjacently arranged in a matrix form in two directions, that is, arrangement direction A (first direction) and arrangement direction B (second direction), so that they do not overlap with one another and have the respective sides in common. The arrangement direction A is the longitudinal direction of the ink-jet head 1, that is, the extension direction of the sub-manifold 5*a* and is parallel to a short diagonal line of the rhombic area 10*x*. The arrangement direction B is a direction of one oblique side of the rhombic area 10*x* forming an obtuse angle with respect to the arrangement direction A. The pressure chamber 10 and the corresponding rhombic area 10*x* share the center position, and border lines of both are separate from each other when viewed on a plane.

The pressure chambers 10 adjacently arranged in a matrix form in the two directions of the arrangement direction A and the arrangement direction B are separate from each other by a distance equivalent to 37.5 dpi in the arrangement direction A. Besides, in one ink discharge area, 16 pressure chambers 10 are disposed in the arrangement direction B. The pressure chambers at both ends in the arrangement direction B are dummy and do not contribute to ink discharge.

The plural pressure chambers 10 disposed in a matrix form constitute plural pressure chamber lines in the arrangement direction A shown in FIG. 5. The pressure chamber lines are classified into a first pressure chamber line 11*a*, a second pressure chamber line 11*b*, a third pressure chamber line 11*c*, and a fourth pressure chamber line 11*d* according to the relative position to the sub-manifold 5*a* when viewed in a direction (third direction) vertical to the paper surface of FIG. 5. These first to fourth pressure chamber lines 11*a* to 11*d* are periodically arranged by fours in sequence of 11*c*. 11*d*. 11*a*. 11*b*. 11*c* . 11*d*. . . . 11*b* from the upper side of the actuator unit 21 to the lower side.

In pressure chambers 10*a* constituting the first pressure chamber line 11*a* and pressure chambers 10*b* constituting the second pressure chamber line 11*b*, when viewed in the third direction, with respect to a direction (fourth direction) orthogonal to the arrangement direction A, the nozzles 8 are unevenly distributed on the lower side of the paper surface of FIG. 5. The nozzles 8 are respectively positioned at the lower ends of the corresponding rhombic areas 10*x*. On the other hand, in pressure chambers 10*c* constituting the third pressure chamber line 11*c* and pressure chambers 10*d* constituting the fourth pressure chamber line 11*d*, with respect to the fourth direction, the nozzles 8 are unevenly distributed on the upper side of the paper surface of FIG. 5. The nozzles 8 are respectively positioned at the upper ends of the corresponding rhombic areas 10*x*. In the first and the fourth pressure chamber lines 11*a* and 11*d*, when viewed in the third direction, half or more of the pressure chambers 10*a* and 10*d* overlap with the sub-manifold 5*a*. In the second and the third pressure chamber lines 11*b* and 11*c*, none of areas of the pressure chambers 10*b* and 10*c* overlap with the sub-manifold 5*a*. Thus, with respect to the pressure chamber 10 belonging to any pressure chamber line, while the nozzle 8 communicating with this is made not to overlap with the sub-manifold 5*a*, the width of the sub-manifold 5*a* is made as wide as possible, and ink can be smoothly supplied to the respective pressure chambers 10.

Figure 6:
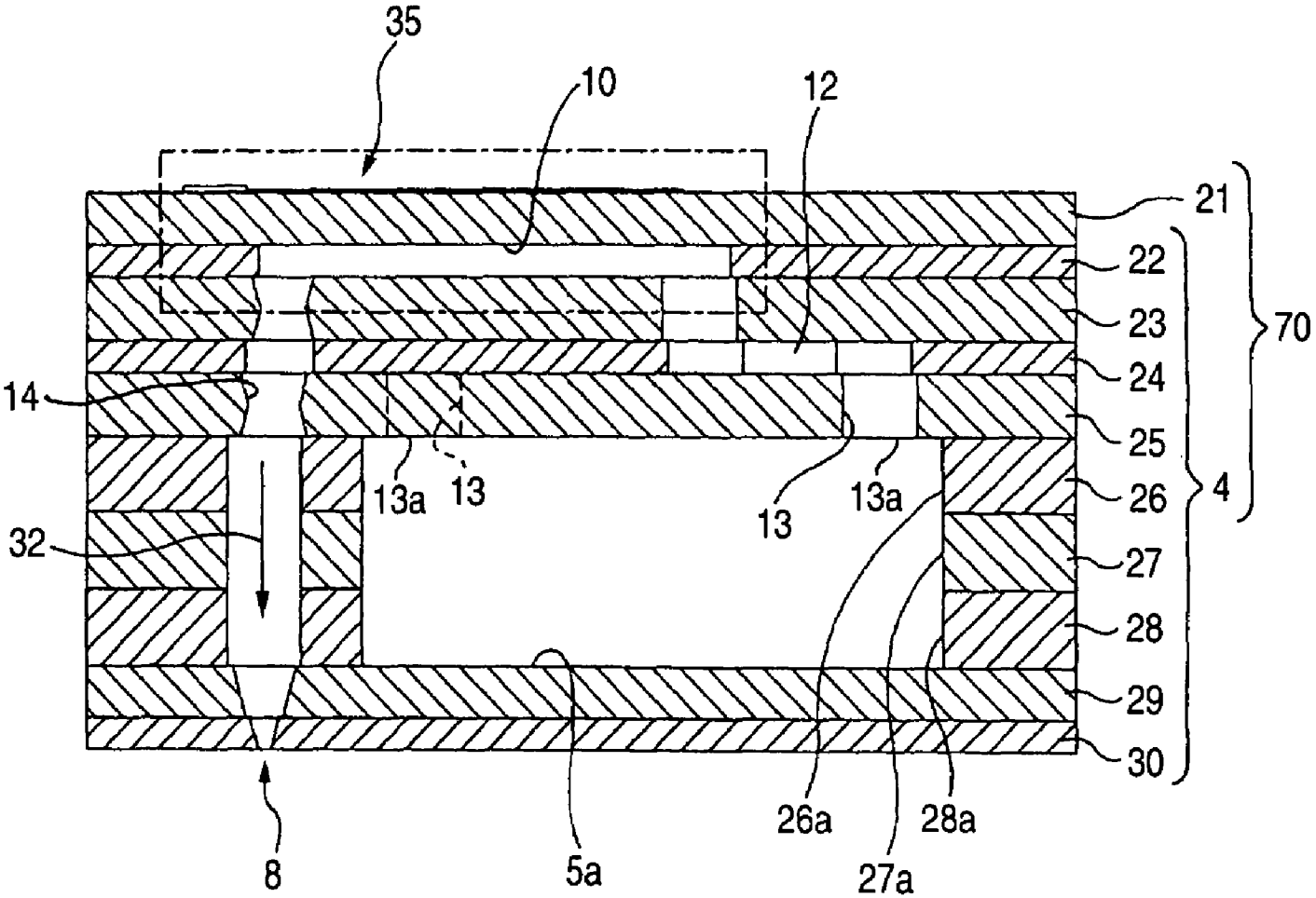
FIG. 6 is a sectional view taken along line VI-VI of FIG. 5.

Next, a sectional structure of the head main body 70 will be further described with reference to FIGS. 6 and 7. FIG. 6 is a sectional view taken along line VI-VI of FIG. 5 and shows the pressure chamber 10*a* belonging to the first pressure chamber line 11*a*. As is understood from FIG. 6, each of the nozzles 8 communicates with the sub-manifold 5*a* through the pressure chamber 10 (10*a*), the aperture 12 and a communication hole 13. In this way, an individual ink flow path 32 extending from an ink supply port 13*a* of the communication hole 13 as an outlet of the sub-manifold 5*a* through the aperture 12 and the pressure chamber 10 to the nozzle 8 is formed for each of the pressure chambers 10.

As is apparent from FIG. 6, the pressure chamber 10 and the aperture 12 are provided at different levels. By this, as shown in FIG. 5, in the flow path unit 4 corresponding to the ink discharge area under the actuator unit 21, the aperture 12 communicating with one pressure chamber 10 can be arranged at the same position as the pressure chamber 10 adjacent to the one pressure chamber when viewed on a plane. As a result, since the pressure chambers 10 are arranged closely and at high density, high resolution image printing can be realized by the ink-jet head 1 having a relatively small occupied area.

Figure 7:
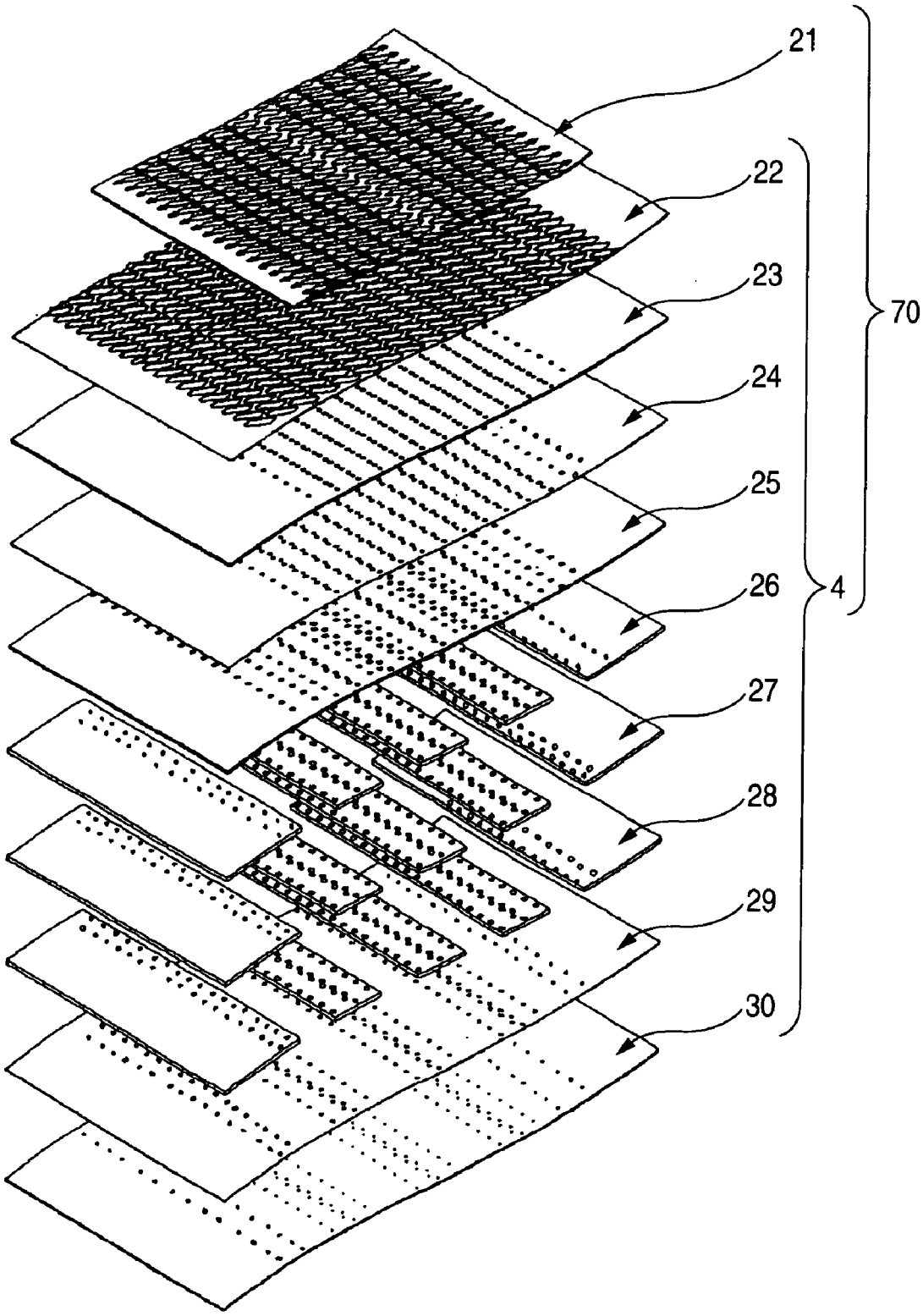
FIG. 7 is a partial exploded perspective view of a head main body shown in FIG. 6.

As is understood from FIG. 7, the head main body 70 has a lamination structure in which ten sheet-like members in total, that is, an actuator unit 21, a cavity plate 22, a base plate 23, an aperture plate 24, a supply plate 25, manifold plates 26, 27 and 28, a cover plate 29 and a nozzle plate 30 from the top are laminated through adhesive. Among these, the nine plates except the actuator unit 21 constitute the flow path unit 4.

As described later, the actuator unit 21 is such that four piezoelectric sheets 41 to 44 (see FIG. 9) are laminated and an electrode is disposed so that only the uppermost layer thereof is a layer (hereinafter simply referred to as "a layer including an active layer") having a portion which becomes an active layer at the time of electric field application, and the three remaining layers are non-active layers. The cavity plate 22 is a metal plate in which many substantially rhombic openings corresponding to the pressure chambers 10 are provided. The base plate 23 is a metal plate in which with respect to one of the pressure chambers 10 of the cavity plate 22, a communication hole between the pressure chamber 10 and the aperture 12 and a communication hole from the pressure chamber 10 to the nozzle 8 are provided. The aperture plate 24 is a metal plate in which with respect to one of the pressure chambers 10 of the cavity plate 22, in addition to the aperture 12, a communication hole from the pressure chamber 10 to the nozzle 8 is provided. The supply plate 25 is a metal plate in which with respect to one of the pressure chambers 10 of the cavity plate 22, the communication hole 13 for communicating the aperture 12 with the sub-manifold 5*a* and the connection hole 14 from the pressure chamber 10 to the nozzle 8 are provided. The manifold plates 26, 27 and 28 are metal plates in which with respect to one of the pressure chambers 10 of the cavity plate 22, in addition to the sub-manifold 5*a*, communication holes from the pressure chamber 10 to the nozzle 8 are respectively provided. The cover plate 29 is a metal plate in which with respect to one of the pressure chambers 10 of the cavity plate 22, a communication hole from the pressure chamber 10 to the nozzle plate 8 is provided. The nozzle plate 30 is a metal plate in which with respect to one of the pressure chambers 10 of the cavity plate 22, the nozzle 8 is provided.

These ten sheets 21 to 30 are positioned to each other and laminated so that the individual ink flow path 32 as shown in FIG. 6 is formed. The individual ink flow path 32 first goes upward from the sub-manifold 5*a*, extends horizontally in the aperture 12, and then, further goes upward, extends horizontally again in the pressure chamber 10, slightly goes obliquely downward in a direction of moving away from the aperture 12, and goes vertically downward toward the nozzle 8.

As is understood from FIG. 6, the sub-manifold 5*a* is formed in the manifold plates 26 to 28 and is constructed such that the entire through holes 26*a* to 28*a* having the same opening area are overlapped with each other when viewed on a plane. Among inner wall surfaces of the inside of the sub-manifold 5*a* in which ink flows, the upper surface is a flat lower surface of the supply plate 25, and the bottom surface of the sub-manifold 5*a* is constructed of a flat upper surface of the cover plate 29. Since the sub-manifold 5*a* is formed in the structure as stated above, the structure of the flow path unit 4 is simple. The ink supply port 13*a* of the through communication hole 13 to communicate the aperture 12 with the sub-manifold 5*a* is formed in the upper surface of the sub-manifold 5*a*.

Figure 8:
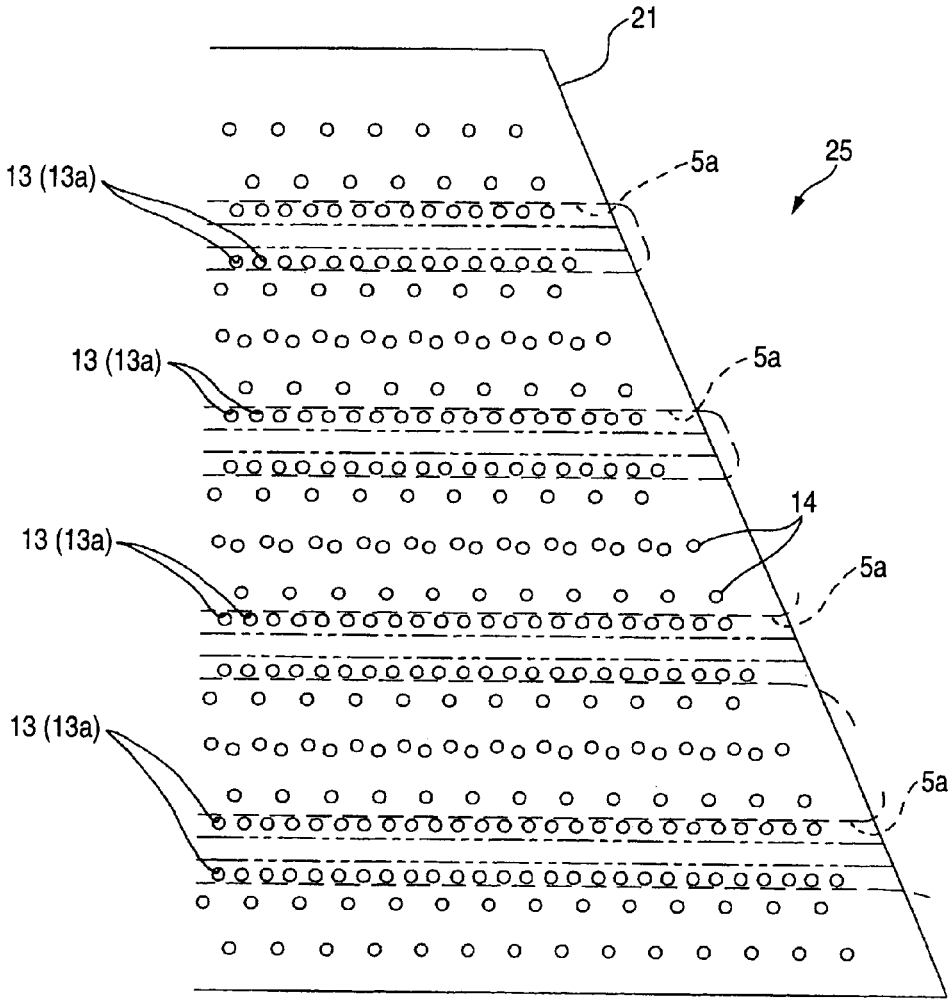
FIG. 8 is an enlarged view of the area surrounded by the one-dot chain line drawn in FIG. 4 and showing a supply plate constituting a flow path unit viewed from above.

FIG. 8 is an enlarged view of an area surrounded by a one-dot chain line drawn in FIG. 4 and shows the supply plate constituting the flow path unit viewed from above. As shown in FIG. 8, plural communication holes 13 communicating with the sub-manifold 5*a* and plural connection holes 14 communicating with the nozzles 8 are formed in the supply plate 25. The plural connection holes 14 are arranged correspondingly to the nozzles 8 such that part thereof overlap with each other when viewed on a plane. The ink supply ports 13*a* of the communication holes 13 formed in the upper surface of the sub-manifold 5*a* are provided in areas close to both ends of each of the sub-manifolds 5*a* in the longitudinal direction, and while being arranged in the longitudinal direction of the sub-manifold 5*a*, they are spaced from each other at almost equal intervals in the longitudinal direction of the sub-manifold 5*a*. The areas close to both ends stated here are the areas in which in a case where plural air bubbles exist in the sub-manifold 5*a*, among those bubbles, there can exist air bubbles being in contact with the upper surface and the side surface of the inside of the sub-manifold 5*a* at two points. When the number of contacts to the wall surface increases, the air bubble becomes hard to eject. Incidentally, a two-dot chain line drawn in FIG. 8 shows a state where the sub-manifold 5*a* is divided into three equal parts in the width direction orthogonal to the longitudinal direction of the sub-manifold 5*a* so as to form a center area and both side areas in the sub-manifold 5*a*. In this embodiment, the area portions at both sides of the sub-manifold 5*a* divided into three equal parts are almost the same areas as the areas close to both the side ends.

Besides, the plural ink supply ports 13 in this embodiment are formed only in the areas close to both the side ends of the sub-manifold 5*a* as shown in FIG. 8 and are arranged in the longitudinal direction of the sub-manifold 5*a* not to shift in the width direction of the sub-manifold 5*a*. Since the ink supply ports 13*a* are arranged as stated above, in the case where air bubbles exist in the sub-manifold 5*a*, when the air bubbles are ejected to the outside from the nozzles by a not-shown purge mechanism, hard-to-move air bubbles being in contact at two points in the sub-manifold 5*a* can be efficiently ejected.

The respective ink supply ports 13*a* have the same opening square measure. Accordingly, a manufacture process of forming the ink supply ports 13*a* in the supply plate 25 becomes simple, and the design thereof also becomes simple.

The ink supply ports 13*a* may be slightly shifted in the width direction of the sub-manifold 5*a*, and part of the ink supply ports 13*a* have only to be overlapped with each other in the width direction of the sub-manifold 5*a* when viewed in the longitudinal direction of the sub-manifold 5*a*. By doing so, when an air bubble being in contact with the upper surface of the sub-manifold 5*a* at one point and at a position separate from the side wall of the sub-manifold 5*a* is ejected to the outside, it can be ejected more efficiently. That is, by making the distance between the air bubble separate from the side wall of the sub-manifold 5*a* and the ink supply port 13*a* as short as possible, the air bubble can be ejected more efficiently.

Figure 9A:
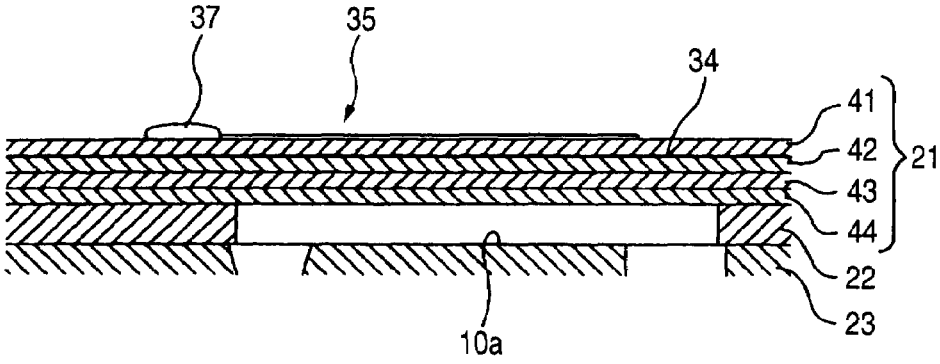
FIG. 9A is an enlarged sectional view of a portion surrounded by a one-dot chain line in FIG. 6.
Figure 9B:
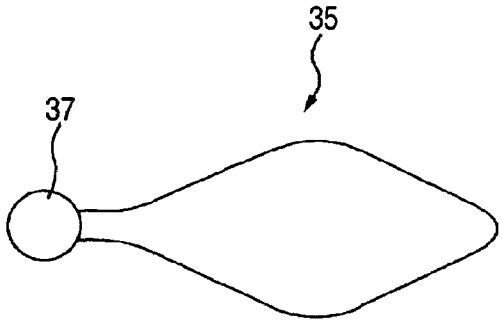
FIG. 9B is a enlarged plan view a portion surrounded by a one-dot chain line in FIG. 6.

FIG. 9 is an enlarged view of a portion surrounded by a one-dot chain line in FIG. 6, in which FIG. 9A is a sectional view and FIG. 9B is a plan view. The actuator unit 21 shown in FIG. 9A includes four piezoelectric sheets 41 to 44 respectively having same thicknesses of about 15 μm. These piezoelectric sheets 41 to 44 are continuous laminar flat plates (continuous flat layers) arranged to extend over the many pressure chambers 10 formed in one ink discharge area of the head main body 70. Since the piezoelectric sheets 41 to 44, as the continuous flat layers, are arranged to extend over the many pressure chambers 10, the individual electrodes 35 can be arranged on the piezoelectric sheet 41 at high density by using, for example, a screen printing technique. Thus, the pressure chambers 10 formed at positions corresponding to the individual electrodes 35 can also be arranged at high density, and printing of a high resolution image becomes possible. The piezoelectric sheets 41 to 44 are made of ceramic material of lead zirconate titanate (PZT) having ferroelectricity.

The individual electrode 35 is formed on the piezoelectric sheet 41 of the uppermost layer. A common electrode 34 formed on the whole surface of the sheet and having a thickness of about 2 μm intervenes between the piezoelectric sheet 41 of the uppermost layer and the lower piezoelectric sheet 42. An electrode is not disposed between the piezoelectric sheet 42 and the piezoelectric sheet 43 and between the piezoelectric sheet 43 and the piezoelectric sheet 44. Both the individual electrode 35 and the common electrode 34 are made of metal material such as Ag—Pd.

The individual electrode 35 has a thickness of approximately 1 μm, and as shown in FIG. 9B, it has substantially a rhombic plane shape almost similar to the pressure chamber 10. One of acute angle parts of the substantially rhombic individual electrode 35 is extended, and its end is provided with a circular land part 37 electrically connected to the individual electrode 35 and having a diameter of about 160 μm. The land part 37 is made of, for example, gold containing glass frit.

The common electrode 34 is grounded in a not-shown area. By this, the common electrode 34 is equally kept at the ground potential in the areas corresponding to all the pressure chambers 10. Besides, the individual electrodes 35 are connected to the driver IC 80 through the FPC 50 including different lead lines independent for the respective individual electrodes 35, so that the potentials corresponding to the respective pressure chambers 10 can be controlled (see FIGS. 1 and 2).

Next, the driving method of the actuator unit 21 will be described. The polarization direction of the piezoelectric sheet 41 of the actuator unit 21 is its thickness direction. That is, the actuator unit 21 has a so-called unimorph type structure in which the upper (that is, far from the pressure chamber 10) one piezoelectric sheet 41 is made a layer in which an active layer exists, and the lower (that is, close to the pressure chamber 10) three piezoelectric sheets 42 to 44 are made non-active layers. Accordingly, when the individual electrode 35 is made to have a specified positive or negative potential, for example, when the electric field and the polarization are in the same direction, the electric field application portion sandwiched between the electrodes in the piezoelectric sheet 41 functions as the active layer (pressure generation part), and shrinks in the direction normal to the polarization direction according to a piezoelectric transverse effect. On the other hand, since the piezoelectric sheets 42 to 44 are not influenced by the electric field, they do not spontaneously vary, and therefore, a difference occurs in distortion in a direction vertical to the polarization direction between the piezoelectric sheet 41 of the upper layer and the piezoelectric sheets 42 to 44 of the lower layers, and the whole of the piezoelectric sheets 41 to 44 is deformed to protrude toward the non-active side (unimorph deformation). At this time, as shown in FIG. 9A, since the lower surface of the piezoelectric sheets 41 to 44 is fixed to the upper surface of the cavity plate 22 for defining the pressure chamber, eventually, the piezoelectric sheets 41 to 44 are deformed to protrude toward the pressure chamber side. Thus, the volume of the pressure chamber 10 is decreased, the pressure of ink is raised, and the ink is discharged from the nozzle 8. Thereafter, when the individual electrode 35 is returned to have the same potential as the common electrode 34, the piezoelectric sheets 41 to 44 are returned to have the original shape, and the volume of the pressure chamber 10 is returned to the original volume, and therefore, ink is sucked from the manifold 5 side.

As another driving method, the individual electrode 35 is previously made to have a potential different from the common electrode 34, the individual electrode 35 is once made to have the same potential as the common electrode 34 each time a discharge request is made, and the individual electrode 35 can be made again to have the potential different from the common electrode 34 at specified timing. In this case, the piezoelectric sheets 41 to 44 are returned to have the original shape at the timing when the individual electrode 35 and the common electrode 34 have the same potential, so that the volume of the pressure chamber 10 is increased as compared with the initial state (state where the potentials of both the electrodes are different from each other), and ink is sucked from the manifold 5 side into the pressure chamber 10. Thereafter, the piezoelectric sheets 41 to 44 are deformed to protrude toward the pressure chamber 10 side at the timing when the individual electrode 35 is made again to have the potential different from the common electrode 34, and the volume of the pressure chamber 10 is decreased, so that the pressure to the ink is raised, and the ink is discharged.

A return is made to FIG. 5, and consideration will be given to a band-like area R having a width (678 μm) equivalent to 37.5 dpi in the arrangement direction A and extending in the arrangement direction B. In the band-like area R, only one nozzle 8 exists with respect to any line of the 16 pressure chamber lines 11*a* to 11*d*. That is, in the case where the band-like area R as stated above is defined at an arbitrary position in the ink discharge area corresponding to one actuator unit 21, 16 nozzles 8 are always distributed in this band-like area R. Positions of points obtained by projecting the 16 nozzles 8 onto a straight line extending in the arrangement direction A are spaced from each other by a distance equivalent to 600 dpi as the resolution at the time of printing.

When the 16 nozzles 8 are denoted by (1) to (16) in sequence from the left of positions obtained by projecting the 16 nozzles 8 belonging to the one band-like area R onto the straight line extending in the arrangement direction A, the 16 nozzles 8 are arranged in sequence of (1), (9), (5), (13), (2), (10), (6), (14), (3), (11), (7), (15), (4), (12), (8) and (16) from the bottom. In the ink-jet head 1 constructed as stated above, when the actuator unit 21 is suitably driven in accordance with the transport of a printing medium, a character or a drawing having a resolution of 600 dpi can be drawn.

A description will be given to a case where for example, a straight line extending in the arrangement direction A is printed at a resolution of 600 dpi. First, a description will be given in brief to a case of a reference example in which the nozzle 8 communicates with an acute angle part of the pressure chamber 10 at the same side. In this case, in response to the transport of the printing medium, discharge of ink is started from the nozzles 8 in the pressure chamber line located at the lowermost position in FIG. 5, and the nozzles 8 belonging to the upper adjacent pressure chamber line are sequentially selected and ink is discharged. By this, dots of ink are formed adjacently at intervals of 600 dpi in the arrangement direction A. Finally, the straight line extending in the arrangement direction A is drawn at a resolution of 600 dpi in total.

On the other hand, in this embodiment, discharge of ink is started from the nozzles in the pressure chamber line 11*b* positioned at the lowest part in FIG. 5, and in response to the transport of a printing medium, the nozzles 8 communicating with the upper adjacent pressure chambers are sequentially selected and ink is discharged. At this time, since displacements of positions of the nozzles 8 in the arrangement direction A at each time a pressure chamber line rises from a lower side to an upper side are not equal to each other, dots of ink sequentially formed in the arrangement direction A in response to the transport of the printing medium are not arranged at equal intervals of 600 dpi.

That is, as shown in FIG. 5, in response to the transport of the printing medium, first, ink is discharged from the nozzles (1) communicating with the lowermost pressure chamber line 11*b* in the drawing, and a line of dots are formed at intervals corresponding to 37.5 dpi on the printing medium. Thereafter, the printing medium is transported and when the formation position of the straight line reaches the position of the nozzle (9) communicating with the second pressure chamber line 11*a* from the bottom, ink is discharged from this nozzle (9). By this, a second ink dot is formed at a position which is displaced by a distance eight times the interval equivalent to 600 dpi from the first formed dot position in the arrangement direction A.

Next, the printing medium is transported and when the formation position of the straight line reaches the position of the nozzle (5) communicating with the third pressure chamber line 11*d* from the bottom, ink is discharged from the nozzle (5). By this, a third ink dot is formed at the position which is displaced by a distance four times the interval equivalent to 600 dpi from the first formed dot position in the arrangement direction A. Further, the printing medium is transported and when the formation position of the straight line reaches the position of the nozzle (13) communicating with the fourth pressure chamber line 11*c* from the bottom, ink is discharged from the nozzle (13). By this, a fourth ink dot is formed at a position which is displaced by a distance 12 times the interval equivalent to 600 dpi from the first formed dot position in the arrangement direction A. Further, the printing medium is transported and when the formation position of the straight line reaches a position of the nozzle (2) communicating with the fifth pressure chamber line 11*b* from the bottom, ink is discharged from the nozzle (2). By this, a fifth ink dot is formed at a position which is displaced by an interval equivalent to 600 dpi from the first formed dot position in the arrangement direction A.

Similarly, in the following, while sequentially selecting the nozzle 8 communicating with the pressure chamber 10 positioned at an upper side from a lower side in the drawing, ink dots are formed. At this time, when the number of the nozzle 8 shown in FIG. 5 is N, an ink dot is formed at a position which is displaced by a distance equivalent to (magnification n=N−1). (interval equivalent to 600 dpi) from the first formed dot position in the arrangement direction A. Finally, when the 16 nozzles 8 have been selected, adjacent ink dots formed at intervals equivalent to 37.5 dpi by the nozzles (1) in the lowermost pressure chamber line 11*b* in the drawing are connected by 15 dots formed to be separate from each other at intervals equivalent to 600 dpi, and it is possible to draw the straight line extending in the arrangement direction A at a resolution of 600 dpi in total.

Incidentally, in the vicinities of both ends (oblique sides of the actuator unit 21) of each of the ink discharge areas in the arrangement direction A, a complementary relation is established with the vicinities of, in the arrangement direction A, both ends of the ink discharge area corresponding to another opposite actuator unit 21 in the width direction of the head main body 70, so that printing at a resolution of 600 dpi becomes possible.

Figure 10A:
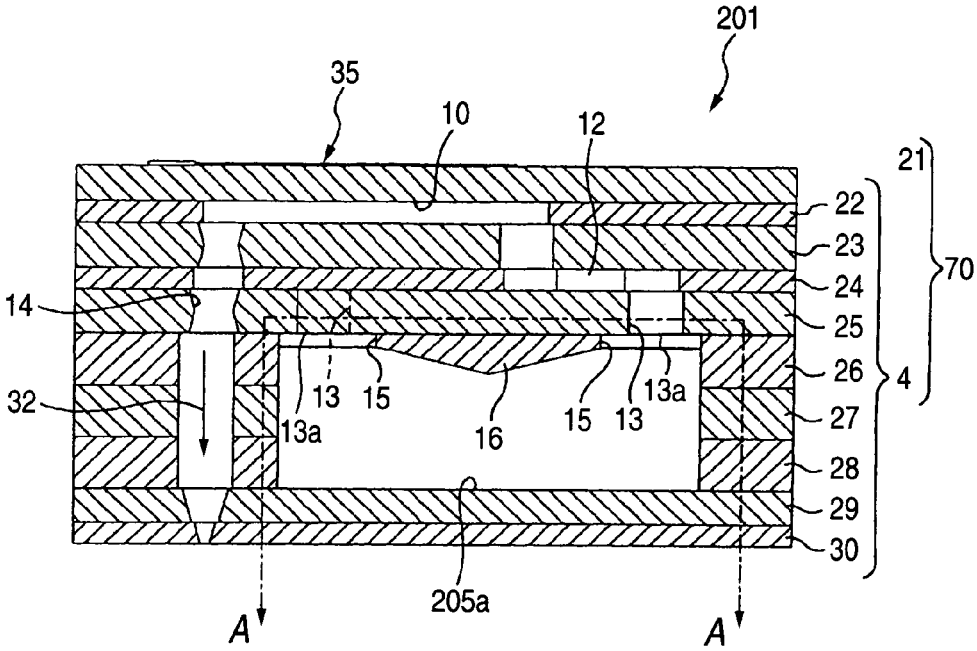
FIG. 10A is an enlarged sectional view of a head main body of an ink-jet head according to a second embodiment of the invention in a similar place to that of the sectional view shown in FIG. 6.
Figure 10B:
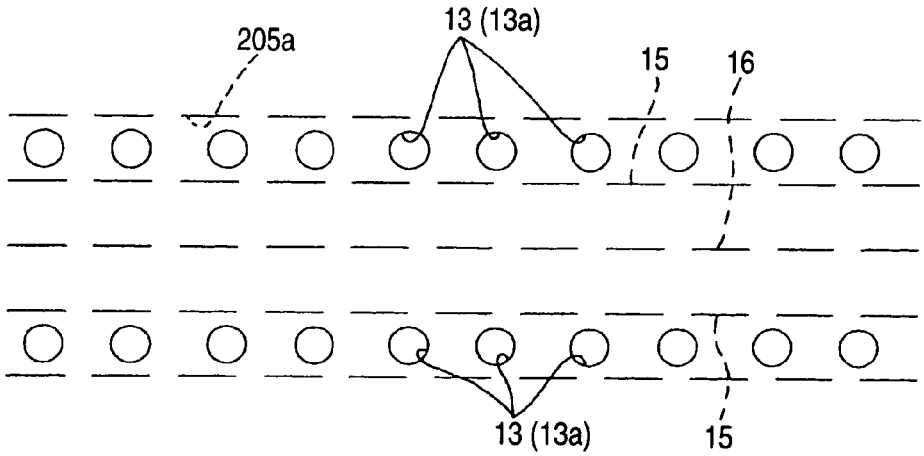
FIG. 10B is a sectional view of the head main body of an ink-jet head according to a second embodiment of the invention, which taken along line A-A of FIG. 10A.

Next, an ink-jet head of a second embodiment will be described below. FIG. 10 shows a head main body of the ink-jet head according to the second embodiment of the invention, in which FIG. 10A is an enlarged sectional view of a place similar to the sectional view shown in FIG. 6, and FIG. 10B is a sectional view taken along line A-A of FIG. 10A. Incidentally, same parts as those of the foregoing ink-jet head 1 are denoted by the same symbols and their description will be omitted.

An ink-jet head 201 shown in FIGS. 10A and 10B is almost similar to the ink-jet head 1, and merely an upper surface shape of a sub-manifold 205*a* of a flow path unit 4 is different from the foregoing ink-jet head 1.

The sub-manifold 205*a* of the flow path unit 4 of the ink-jet head 201 is constructed by laminating a supply plate 25, three manifold plates 26', 27 and 28 and a cover plate 29. In the foregoing sub-manifold 5*a*, although its upper surface is the lower surface of the supply manifold 25, the upper surface of the sub-manifold 205*a* in this embodiment is a residual portion remaining after the lower surface side of the manifold plate 26' is etched in two stages. That is, the manifold plate 26' is subjected to half-etching from the lower side of the manifold plate 26' so as to have the same opening square measure as the through hole 26*a* of the foregoing manifold plate 26 and so as to have a protrusion 16 in which a center area portion equivalent to an upper surface of the sub-manifold 205*a* protrudes downward. Two through parts 15 are formed by second etching so that ink supply ports 13*a* formed in the upper surface of the sub-manifold 205*a* and in areas close to both side ends of the sub-manifold 205*a* communicate with the sub-manifold 205*a*. The two through parts 15 are formed for one sub-manifold 205*a* in the longitudinal direction of the sub-manifold 205*a*, and the width of each of the through part 15 in the sub-manifold 205*a* is formed to be larger than the diameter of the ink supply port 13*a*. Incidentally, the through part 15 becomes the recess 15 as shown in FIG. 10A in the case where the flow path unit 4 and the sub-manifold 205*a* are constructed of the supply plate 25, the three manifold plates 26', 27 and 28, and the cover plate 29. Accordingly, in the following description, the through part 15 is referred to as the recess 15.

The protrusion 16 formed on the upper surface of the sub-manifold 205*a* has a most protruded center portion, and has a taper part 16*a* formed such that a protrusion amount is decreased from the most protruded portion to the recesses 15 positioned at both ends in FIG. 10A. The recesses 15 and the protrusions 16 are extended in parallel to the longitudinal direction of the sub-manifold 205*a* as shown in FIG. 10B.

As stated above, since the recess 15 is formed in the upper surface of the sub-manifold 205*a*, in the case where air bubbles exist in the sub-manifold 205*a*, when the air bubbles are moved in the recess 15, it becomes easy to eject the air bubbles from the nozzle 8 to the outside through the ink supply port 13*a*. That is, when the air bubbles in the sub-manifold 205*a* are moved in the recess 15 having a large opening square measure, since the air bubbles are lighter than ink, it becomes hard to move the air bubbles from the recess 15 to an area other than the recess 15 of the sub-manifold 205*a*. Thus, when an attempt is made to eject the air bubbles by a not-shown purge mechanism, the air bubbles can be easily ejected to the outside from the ink supply port 13*a* arranged in the longitudinal direction of the recess 15 and communicating with the recess 15. Besides, since the width of the recess 15 is larger than the diameter of the ink supply port 13*a*, in the case where the air bubbles are ejected, since the air bubbles can be smoothly moved in the recess 15 (that is, it becomes hard for the air bubbles in the recess 15 to come in contact with the inner surface of the recess 15 at three points), the ejection of the air bubbles is further facilitated.

Since the projection 16 is formed in the center area of the upper surface of the sub-manifold 205*a*, the air bubbles in the sub-manifold 205*a* are forcibly moved to areas (here, areas corresponding to the inside of the recesses 15) close to both side ends of the sub-manifold 205*a*. Thus, since movement of the air bubbles into the recess 15 is facilitated, the air bubbles can be efficiently ejected.

As described above, according to the ink-jet heads 1 and 201 of the first and the second embodiments, since the ink supply ports 13*a* are provided in the areas close to both side ends of the sub-manifold 5*a*, 205*a* in the longitudinal direction, among air bubbles in the sub-manifold 5*a*, 205*a*, the hard-to-move air bubbles being in contact with the upper surface and the side wall of the sub-manifold 5*a*, 205*a* at two points can be more easily ejected from the ink supply ports 13*a* through the nozzles to the outside than the ink-jet head as disclosed in Japanese Patent No. 3231786. Accordingly, it is possible to reduce poor ink discharge due to air bubbles at the time of printing to a recording medium by the ink-jet head 1, 201. Among air bubbles existing in the sub-manifold 5*a*, 205*a*, since air bubbles existing in the center area or the like other than the areas close to both side ends of the sub-manifold 5*a*, 205*a* and being in contact with the upper surface of the sub-manifold 5*a* 205*a* at one point are relatively easily moved, even if the ink supply ports are provided only in the vicinity of the center area, the air bubbles can be ejected to the outside from the ink supply ports by a purge operation. However, with respect to air bubbles being in contact with the side wall and the upper surface of the sub-manifold 5*a*, 205*a* at two points, their contact areas with the inner surface of the sub-manifold 5*a*, 205*a* become large, it is hard to move the air bubbles in the sub-manifold 5*a*, 205*a*, and further, since the air bubbles are moved in the direction crossing the direction of flow of ink, it becomes difficult to eject the air bubbles being in contact at two points from the ink supply ports to the outside. However, in the invention, since the ink supply ports 13*a* are formed in the areas at both the side of the sub-manifold 5*a*, 205*a* where hard-to-move air bubbles exist or in the areas close to both side ends of the sub-manifold 5*a*, 205*a*, not in the center area where mobile air bubbles exist, it becomes easy to eject both the mobile air bubbles and the hard-to-move air bubbles to the outside from the nozzles through the ink supply ports 13*a*.

Although the preferred embodiments of the invention have been described, the invention is not limited to the foregoing embodiments, and various modifications can be made in the scope of the present claims. For example, in the foregoing embodiments, although the plural ink supply ports 13*a* are arranged only in the areas close to both the side ends of the sub-manifold or in the areas at both the sides of the sub-manifold divided into three equal parts in the width direction, one or not less than two ink supply ports may be formed in the center area of the sub-manifold, and at least as long as the total of the opening square measures of the ink supply ports formed in the areas close to both the side ends of the sub-manifold or the areas at both the sides is larger than the total of the opening square measures of the ink supply ports formed in the center area, as described above, it becomes easy to eject the air bubbles to the outside of the ink-jet head. Besides, the number of the ink supply ports 13*a* in the areas close to both the side ends of the sub-manifold or the areas at both the ends of the sub-manifold divided into three equal parts in the width direction may be smaller than the number of ink supply ports in a case where the ink supply ports are formed in the center area of the sub-manifold. Besides, in the foregoing embodiments, the areas at both the sides of the sub-manifold 5*a* divided into three equal parts in the width direction are not particularly limited, and for example, the sub-manifold is divided into ten equal parts in the width direction, and areas of 3/10 of the ten equal parts at both sides may correspond to the areas at both the sides of the sub-manifold. That is, modifications may be suitably made according to the length of the sub-manifold in the width direction.

Further, although the ink-jet head of the foregoing embodiment is a line-type one, a serial-type ink-jet head may be adopted. Besides, the arrangement direction of the plural pressure chambers 10 arranged in a matrix form along the surface of the flow path unit 4 is not limited to the arrangement directions A and B shown in FIG. 5, and as long as it is along the surface of the flow path unit 4, various directions may be adopted. The area in which the pressure chamber 10 is contained may have various shapes such as a parallelogram, not the rhombic shape, and the plane shape of the pressure chamber 10 itself contained there in may be suitably modified to have another shape. Besides, the flow path unit 4 may not be one formed by laminating plural sheet-like members.

The materials of the piezoelectric sheet and the electrode in the actuator unit 21 are not limited to the foregoing, and may be changed to different well-known materials. An insulating sheet other than the piezoelectric sheet may be used as the non-active layer. The number of layers including the active layer, and the number of non-active layers may be suitably changed, and in accordance with the lamination number of the piezoelectric sheets, the number of individual electrodes and common electrodes may be suitably changed. In the foregoing embodiments, although the common electrode is kept at the ground potential, as long as the potential is common to the respective pressure chambers 10, the common electrode is not limited to this.

Besides, in the actuator unit 21 of the foregoing embodiment, although the non-active layer is arranged at the pressure chamber side of the layer including the active layer, the layer including the active layer may be arranged at the pressure chamber 10 side of the non-active layer, or the non-active layer may not be provided. However, when the non-active layer is provided at the pressure chamber side of the layer including the active layer, it is expected that displacement efficiency of the actuator unit 21 is further improved.

In the above embodiments, as shown in FIG. 4, the two lines of the plural trapezoidal actuator units 21 are arranged in a staggered manner, however, the actuator unit may not always be made trapezoidal, and plural actuator units may be disposed merely in one line in the longitudinal direction of the flow path unit. Alternatively, three or more lines of actuator units may be arranged in a staggered manner. Besides, instead of arranging one actuator unit over the plural pressure chambers 10, one actuator unit 21 may be arranged for each of the pressure chamber 10.

Many common electrode 34 may be formed for the respective pressure chambers 10 so that a projection area to the lamination direction includes a pressure chamber area, or the projection area is included in the pressure chamber area, and it is not always necessary that the common electrode is one conductive sheet provided in almost the whole area of one actuator unit 21. However, at this time, it is necessary that the common electrodes are electrically connected to each other so that all portions corresponding to the pressure chambers 10 have the same potential. Besides, in the second embodiment, in order to facilitate ejection of air bubbles in the sub-manifold 205*a*, the taper part protruding in the sub-manifold 205*a* is formed on the upper surface of the sub-manifold 205*a*, however, as long as a contribution to excellent ejection of air bubbles can be obtained, the upper surface of the sub-manifold may have any shape, and for example, the protrusion of the upper surface of the sub-manifold may be formed of a curved surface.

What is claimed is:

1. An ink-jet head comprising:

plural pressure chambers communicating with nozzles and arranged in a matrix form along a plane so that plural pressure chamber lines are formed in one direction on the plane; and a common ink chamber extending in the one direction and communicating with the plural pressure chambers, wherein the common ink chamber is provided with plural ink supply ports which supplies ink in the common ink chamber to individual ink flow paths extending through the pressure chambers to the nozzles, and on a wall surface, in which the ink supply ports are formed, of wall surfaces constituting the common ink chamber, a total area of openings of the ink supply ports formed in areas close to both side ends of the common ink chamber in a direction perpendicular to the one direction is larger than a total area of openings of any ink supply ports formed in a center area other than the areas close to both the side ends;

wherein some of the ink supply ports formed close to each of the side ends are connected to some individual flow paths in which ink flows in a first direction inclined with respect to the one direction, and the other ink supply ports formed close to each of the side ends are connected to the other individual flow paths in which the ink flows in a second direction inclined with respect to a direction opposite to the one direction.

2. An ink-jet head according to claim 1, wherein the plural ink supply ports formed in the areas close to both the side ends are arranged to at least partially overlap with each other when viewed in the one direction.

3. An ink-jet head according to claim 1, wherein respective areas of the plural ink supply ports formed in the common ink chamber are equal to each other, and a total number of the ink supply ports formed in the areas close to both the side ends is larger than a total number of the ink supply ports formed in the center area.

4. An ink-jet head according to claim 1, wherein the ink supply ports are formed only in the areas close to both the side ends.

5. An ink-jet head according to claim 4, wherein an inside surface of a wall surface put between both side walls of the common ink chamber is a plane surface.

6. An ink-jet head according to claim 1, wherein an inside surface of a wall surface put between both side walls of the common ink chamber has a shape in which the center area protrudes toward an inside of the common ink chamber.

7. An ink-jet head according to claim 1, wherein at a wall surface put between both side walls of the common ink chamber, a thin and long recess in the one direction is formed in an area surrounding the plural ink supply ports in the one direction.

8. An ink-jet head according to claim 7, wherein a width of the recess in a direction orthogonal to the one direction is larger than a diameter of the ink supply port.

9. An ink-jet head comprising:

plural pressure chambers communicating with nozzles and arranged in a matrix form along a plane so that plural pressure chamber lines are formed in one direction on the plane; and a common ink chamber extending in the one direction and communicating with the plural pressure chambers, wherein the common ink chamber is provided with plural ink supply ports for supplying ink in the common ink chamber to individual ink flow paths extending through the pressure chambers to the nozzles, and on a wall surface, in which the ink supply ports are formed, of wall surfaces constituting the common ink chamber, a total area of openings of the ink supply ports formed in areas at both sides of the common ink chamber divided into three equal parts in a direction perpendicular to the one direction is larger than a total area of openings of any ink supply ports formed in a center area other than the areas at both the sides;

wherein some of the ink supply ports formed close to each of the side ends are connected to some individual flow paths in which ink flows in a first direction inclined with respect to the one direction, and the other ink supply ports formed close to each of the side ends are connected to the other individual flow paths in which the ink flows in a second direction inclined with respect to a direction opposite to the one direction.

10. An ink-jet head according to claim 9, wherein the plural ink supply ports formed in the areas at both the sides are arranged to at least partially overlap with each other when viewed in the one direction.

11. An ink-jet head according to claim 9, wherein respective areas of the plural ink supply ports formed in the common ink chamber are equal to each other, and a total number of the ink supply ports formed in the areas at both the sides is larger than a total number of the ink supply ports formed in the center area.

12. An ink-jet head according to claim 9, wherein the ink supply ports are formed only in the areas at both the sides.

13. An ink-jet head according to claim 12, wherein an inside surface of a wall surface put between both side walls of the common ink chamber is a plane surface.

14. An ink-jet head according to claim 9, wherein an inside surface of a wall surface put between both side walls of the common ink chamber has a shape in which the center area protrudes toward an inside of the common ink chamber.

15. An ink-jet head according to claim 9, wherein at a wall surface put between both side walls of the common ink chamber, a thin and long recess in the one direction is formed in an area surrounding the plural ink supply ports in the one direction.

16. An ink-jet head comprising:

plural pressure chambers communicating with nozzles and arranged in a matrix form along a plane so that plural pressure chamber lines are formed in one direction on the plane; and a common ink chamber extending in the one direction and communicating with the plural pressure chambers, wherein the common ink chamber is provided with plural ink supply ports which supplies ink in the common ink chamber to individual ink flow paths extending through the pressure chambers to the nozzles, and on a wall surface, in which the ink supply ports are formed, of wall surfaces constituting the common ink chamber, a total area of openings of the ink supply ports formed in areas close to both side ends in a direction perpendicular to the one direction is larger than a total area of openings of any ink supply ports formed in a center area other than the areas close to both the side ends of the common ink chamber, wherein some of the ink supply ports formed close to each of the side ends is connected to some individual flow paths in which ink flows in a first direction inclined with respect to the one direction, and the other ink supply ports formed close to each of the side ends is connected to the other individual flow paths in which the ink flows in a second direction inclined with respect to a direction opposite to the one direction; and an inside surface of the wall surface put between both side walls of the common ink chamber has a shape in which the center area protrudes toward an inside of the common ink chamber.

17. An ink-jet head according to claim 16, wherein the plural ink supply ports formed in the areas close to both the side ends are arranged to at least partially overlap with each other when viewed in the one direction.

18. An ink-jet head according to claim 16, wherein respective square areas of the plural ink supply ports formed in the common ink chamber are equal to each other, and a total number of the ink supply ports formed in the areas close to both the side ends is larger than a total number of the ink supply ports formed in the center area.

19. An ink-jet head according to claim 16, wherein the ink supply ports are formed only in the areas close to both the side ends.

20. An ink-jet head according to claim 16, wherein at a wall surface put between both side walls of the common ink chamber, a thin and long recess in the one direction is formed in an area surrounding the plural ink supply ports in the one direction.

* * * * *